US012723764B2

(12) United States Patent
Zhou et al.

(10) Patent No.: US 12,723,764 B2
(45) Date of Patent: Sep. 1, 2026

(54) INTEGRATED COOKING RANGE HEAD ASSEMBLY DEVICE HAVING FLOW-CONTROL NOISE REDUCTION FUNCTION AND SELF-CLEANING FUNCTION AND INTEGRATED COOKING RANGE

(71) Applicant: ZHEJIANG UNIVERSITY OF TECHNOLOGY, Hangzhou (CN)

(72) Inventors: Shuiqing Zhou, Hangzhou (CN); Xinhan Huang, Hangzhou (CN); Laifa Lu, Hangzhou (CN); Zengliang Gao, Hangzhou (CN); Weiya Jin, Hangzhou (CN)

(73) Assignee: ZHEJIANG UNIVERSITY OF TECHNOLOGY, Hangzhou (CN)

( * ) Notice: Subject to any disclaimer, the term of this patent is extended or adjusted under 35 U.S.C. 154(b) by 0 days.

(21) Appl. No.: 19/530,843

(22) Filed: Feb. 5, 2026

(65) Prior Publication Data

US 2026/0168678 A1 Jun. 18, 2026

Related U.S. Application Data

(63) Continuation of application No. PCT/CN2025/119301, filed on Sep. 5, 2025.

(30) Foreign Application Priority Data

Dec. 4, 2024 (CN) ..... 202411769510.5

(51) Int. Cl.
*F24C 14/00* (2006.01)
*F24C 15/20* (2006.01)

(52) U.S. Cl.
CPC ..... *F24C 15/2042* (2013.01); *F24C 14/00* (2013.01); *F24C 15/2035* (2013.01)

(58) Field of Classification Search
CPC ..... F24C 15/2042; F24C 14/00; F24C 15/203
See application file for complete search history.

(56) References Cited

U.S. PATENT DOCUMENTS

2003/0101986 A1* 6/2003 Maier ..... F24C 15/2042 126/299 R
2006/0278215 A1* 12/2006 Gagas ..... F24C 15/2092 126/299 D (Continued)

*Primary Examiner* — Alfred Basichas
(74) *Attorney, Agent, or Firm* — JEEN IP LAW, LLC

(57) ABSTRACT

An integrated cooking range head assembly device having a flow-control noise reduction function and a self-cleaning function and an integrated cooking range are provided. The integrated cooking range head assembly device includes an integrated cooking range head assembly housing, which includes a front baffle, side panels, a rear baffle, and a top panel disposed above the rear baffle, and the front baffle, the side panels, and the rear baffle together form a head air intake duct; an oil filter screen is disposed between the front baffle and the rear baffle, a temperature sensor is disposed on a top of the rear baffle, and a flow-guiding baffle plate assembly is disposed on an inner side of the front baffle to optimize and guide an oil fume flow channel and to achieve the self-cleaning function. Different structures and positions of the flow-guiding baffle plates are optimized using a flow-optimization theory.

9 Claims, 6 Drawing Sheets

(56) References Cited

U.S. PATENT DOCUMENTS

| | | | | |
|---|---|---|---|---|
| 2008/0029081 | A1* | 2/2008 | Gagas | F24C 15/2042 126/299 D |
| 2009/0137201 | A1* | 5/2009 | Huber | F24C 15/2092 126/299 D |
| 2012/0204855 | A1* | 8/2012 | Huber | F24C 15/2092 126/299 R |
| 2013/0319400 | A1* | 12/2013 | Langenbach | F24C 15/2042 126/299 D |
| 2015/0330641 | A1* | 11/2015 | Lillesand | F24C 15/2042 126/299 D |
| 2016/0215988 | A1* | 7/2016 | Braden | F24C 15/2042 |
| 2021/0102710 | A1* | 4/2021 | Braden | F24C 15/36 |
| 2022/0163210 | A1* | 5/2022 | Acosta Herrero | F24C 15/107 |
| 2022/0404032 | A1* | 12/2022 | Wiechert | F24C 15/2021 |
| 2024/0011642 | A1* | 1/2024 | Lacatusu | F24C 15/001 |

* cited by examiner

INTEGRATED COOKING RANGE HEAD ASSEMBLY DEVICE HAVING FLOW-CONTROL NOISE REDUCTION FUNCTION AND SELF-CLEANING FUNCTION AND INTEGRATED COOKING RANGE

TECHNICAL FIELD

The present disclosure belongs to the technical fields of integrated cooking ranges, and in particular to an integrated cooking range head assembly device having a flow-control noise reduction function and a self-cleaning function and an integrated cooking range.

BACKGROUND

The integrated cooking range, as an innovation in kitchen appliances, combines multiple functional modules such as a gas stove, an induction cooker, a disinfection cabinet, and a range hood into a single unit, thereby providing an integrated kitchen solution. An integrated cooking range may be divided into three parts: a head assembly, a fan system and a cooking system. Currently, performance improvement in integrated cooking ranges is primarily focused on the fan system, while research on the head assembly structure has been neglected. The head assembly of an integrated cooking range typically includes two parts: an upper suction chamber and a rear suction duct, with the upper suction chamber positioned above the rear suction duct. The upper suction chamber is provided with a filter screen. Oil fumes generated from cooking are drawn through the filter screen into the upper suction chamber under the negative pressure generate by the fan system. The oil fumes then flow downward into the rear suction duct and subsequently pass through the air box and the exhaust duct before being discharged to the atmosphere. The head assembly design of conventional integrated cooking ranges mainly focuses on external appearance, with limited efforts devoted to optimizing the internal flow channel. In addition, the head assembly of an integrated cooking range typically requires regular disassembly and cleaning, affecting the user experience.

Based on the above analysis, the existing technologies suffer from the following problems and deficiencies:

(1) The head assembly of an integrated cooking range requires regular disassembly for cleaning. There is a lack of an operating mode for self-cleaning of the head assembly to improve the user experience.

(2) The head assembly design of conventional integrated cooking ranges mainly focuses on external appearance, with little research on optimizing the internal flow field of the head assembly.

SUMMARY

Technical problems

To address the above problems, the present disclosure provides an integrated cooking range head assembly device having a flow-control noise reduction function and a self-cleaning function to reduce operating noises of the integrated cooking range while extracting oil fumes, and to optimize the flow of oil fumes at the head assembly and incorporate a self-cleaning module design.

Technical Solutions

In order to realize the above objectives, the present disclosure adopts the following technical solutions:

An integrated cooking range head assembly device having a flow-control noise reduction function and a self-cleaning function, including an integrated cooking range head assembly housing, where the integrated cooking range head assembly housing includes a front baffle, side panels, a rear baffle, and a top panel disposed above the rear baffle, and the front baffle, the side panels, and the rear baffle together form a head air intake duct; an oil filter screen is disposed between the front baffle and the rear baffle, a temperature sensor is disposed on a top of the rear baffle, and a flow-guiding baffle plate assembly is disposed on an inner side of the front baffle to optimize and guide an oil fume flow channel and to achieve the self-cleaning function.

In a further technical solution, slide rails are arranged on both sides of the front baffle, where the slide rails are internally provided with sliding rods, and a telescopic motor is connected to the sliding rods via bolts. The flow-guiding baffle plate assembly is connected to the telescopic motor.

In a further technical solution, the flow-guiding baffle plate assembly includes two flow-guiding baffle plates arranged in parallel on the inner side of the front baffle, with each flow-guiding baffle plate having an arc-shaped outer surface.

In a further technical solution, each flow-guiding baffle plate includes a plate body and a heating tube. The plate body and the heating tube are connected via a snap-fit structure, enabling replacement of the plate body.

In a further technical solution, the heating tube includes a tube body and a resistance wire wound around the tube body; both ends of the heating tube are connected to the telescopic motor; through action of the telescopic motor, the flow-guiding baffle plates can be adjusted forward and backward. The sliding rods can be rotated to adjust the telescopic motor up and down, thereby adjusting the flow-guiding baffle plates upward and downward.

In a further technical solution, the flow-control noise reduction is achieved by parameterizing structures and positions of the flow-guiding baffle plates and optimizing different structures and positions of the flow-guiding baffle plates, and a parameter design of the flow-guiding baffle plates is controlled by four variables: lengths of the flow-guiding baffle plates, thicknesses of the flow-guiding baffle plates, a spacing between the flow-guiding baffle plates, and a distance between the flow-guiding baffle plates and the head assembly, with a specific optimization process as follows:

S1: establishing a spatial rectangular coordinate system, defining positions of the flow-guiding baffle plates and structural parameters of the flow-guiding baffle plates; letting a total lower long side of the head air intake duct be L1 and an inner side of the head air intake duct be L2, and enabling the L1 and the L2 to intersect at a point O, the point O is taken as an origin; setting a direction along the L1 as an X-axis, a direction along the L2 as a Z-axis, and a direction perpendicular to both the X-axis and the Z-axis and passing through the point O along a height direction as a Y-axis, thereby establishing the spatial rectangular coordinate system;

S2: selecting eight points on the front baffle of the integrated cooking range head assembly housing, denoted as A(x1, z1), B(x2, z2), C(x3, z3), D(x4, z4), E(x5, z5), F(x6, z6), G(x7, z7), and H(x8, z8), respectively, where L2 denotes a total height of the side of the integrated cooking range head assembly housing, L1 denotes a total length of the lower side, and L3 denotes a total thickness of the integrated cooking range head assembly housing; segments OA, AB, BC, BD, DE, EF, FG, and FH are all straight lines; the point O is an origin of a coordinate axis, that is, O(0, 0); since segment OA extends along the Z-axis, coordinates of point A are (0, z1); segments AB and BC extend along the X-axis, so coordinates of points B and C are (x1, z1) and (x2, z1), respectively; segments BD and DE extend along the Z-axis, so points D and E have coordinates (x1, z2) and (x1, z3), respectively; segments EF and FG are horizontal, so points F and G have coordinates (x3, z3) and (x4, z3), respectively; and segments FH and HM are vertical, so points H and M have coordinates (x3, z4) and (x3, L2), respectively;

where x1+x2=x3+x4=L1, such that the positions and length coordinates of the flow-guiding baffle plates are completely defined;

S3: selecting four points on the side of the integrated cooking range head assembly housing, denoted as I (y1, z1), J(y2, z2), K(y3, z3) and L(y4, z4), since segments IJ and KL both extend along the Y-axis, and segment IK extends along the Z-axis, coordinates of point K are (0, z5), coordinates of point I are (0, z6), coordinates of point L are (−y1, z5), and coordinates of point J are (−y2, z6), such that the thickness of the flow-guiding baffle plates is completely defined; and S4: performing geometric modeling using 3D design software based on a flow-guiding baffle plate profile determined by the sample points, followed by simulation calculations to obtain an outlet airflow and a noise level of each model; establishing a functional relationship between the design variables, the outlet airflow and the noise level based on an approximate model, and evaluating an accuracy of the approximate model using a coefficient of determination R2; determining a final selected approximate model, and optimizing the final selected approximate model using an optimization algorithm; and determining the structural parameters of the flow-guiding baffle plates based on the obtained optimal solution, performing a final geometric modeling using the 3D design software, and completing the optimization process.

In summary, simulations are performed according to the defined structural parameters of the flow-guiding baffle plates, and optimization is performed according to the overall streamline (without significant vortices) and turbulent kinetic energy, matching different airflow inlet angles for various appliance models to improve overall airflow performance and optimize noise characteristics.

In a further technical solution, the self-cleaning function is achieved by adjusting the positions of the flow-guiding baffle plates and heating the heating tube, specifically including two operating modes:

in a cleaning mode, the heating tube is activated to clean the integrated cooking range head assembly device as a whole by adjusting positions of the flow-guiding baffle plates via the slide rails and the telescopic motor; and a fan system is then activated to carry away dissolved grease and heat the head assembly with hot air, larger oil droplets fall under gravity and are collected in the grease collection hopper of the exhaust duct, while smaller oil droplets are discharged directly; and in a preheating mode, the preheating module is linked to the external temperature sensor. An operating power of the resistance wire is adjusted according to an actual ambient temperature. In winter, when the ambient temperature is low, the operating power of the resistance wire is increased to heat an inlet air, preheating the integrated cooking range head assembly device through the fan system. In summer, when the ambient temperature is high, the resistance wire operates at a low operating power or remains off, providing simple preheating of the integrated cooking range.

In another aspect, the present disclosure further provides an integrated cooking range having a self-cleaning head assembly function, including the integrated cooking range head assembly device having a flow-control noise reduction function and a self-cleaning function as described above, and an integrated cooking range head assembly housing, where the integrated cooking range head assembly device is fixed to an upper portion of the integrated cooking range head assembly housing via bolts, a cooktop is arranged on the upper portion of the integrated cooking range head assembly housing, and a steam oven and a fan system are disposed inside the integrated cooking range head assembly housing.

In a further technical solution, the integrated cooking range head assembly housing further includes air outlets formed on left and right sides of the integrated cooking range, with corresponding exhaust ducts. An outlet of the fan system is in communication with the exhaust ducts, and orientations of the air outlets may be adjusted according to a left-right arrangement of the integrated cooking range. A grease collection hopper is arranged on the exhaust ducts.

Beneficial Effects

Based on the foregoing technical solutions and the technical problems addressed, the beneficial effects of the technical solutions to be protected by the present disclosure are as follows:

(1) through parameterized design of the structures and positions of the flow-guiding baffle plates, different structures and positions of the flow-guiding baffle plates are optimized using a flow-optimization theory.

(2) The integrated cooking range having a self-cleaning head assembly function in the present disclosure utilizes a movable self-heating flow-guiding baffle plates to clean the head assembly, and further employs the fan system to deliver hot air for overall cleaning. This eliminates the need for frequent disassembly and cleaning, thereby improving the user experience.

(3) The flow-guiding baffle plate of the head assembly in the present disclosure has a defined curvature, therefore, based on the Coandă effect, the cleaning steam is allowed to flow along the flow-guiding baffle plates, thereby improving the cleaning effect.

(4) The movable self-heating flow-guiding baffle plates in the present disclosure are linked to the temperature sensor disposed in the head assembly, and are configured to preheat the cooking range by regulating the heating of the resistance wire according to the ambient temperature.

Figure 1:
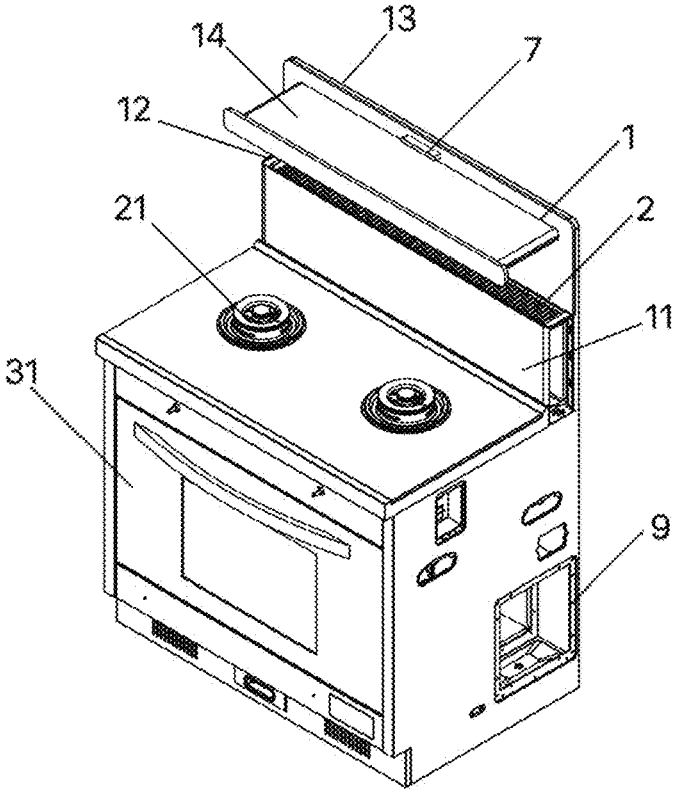
FIG. 1 is a schematic diagram of an overall structure of an integrated cooking range according to the present disclosure.
Figure 2:
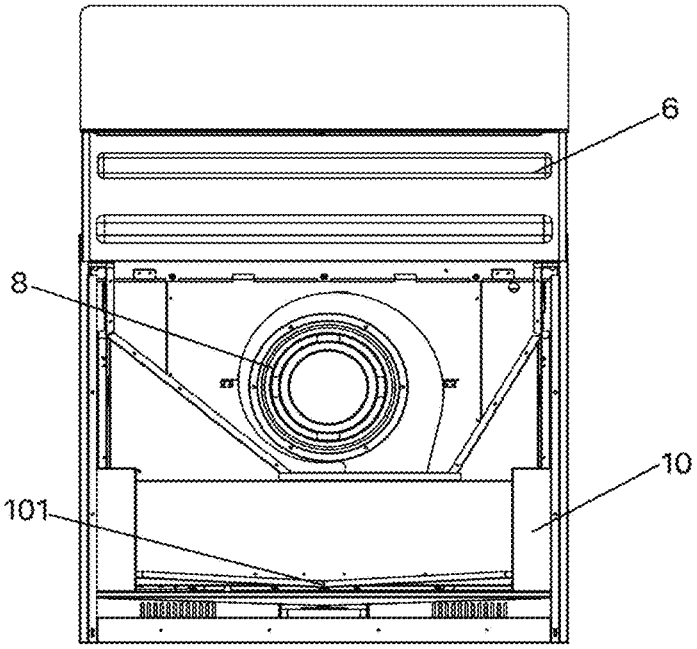
FIG. 2 is a schematic structural diagram of a back of an integrated cooking range according to the present disclosure.
Figure 3:
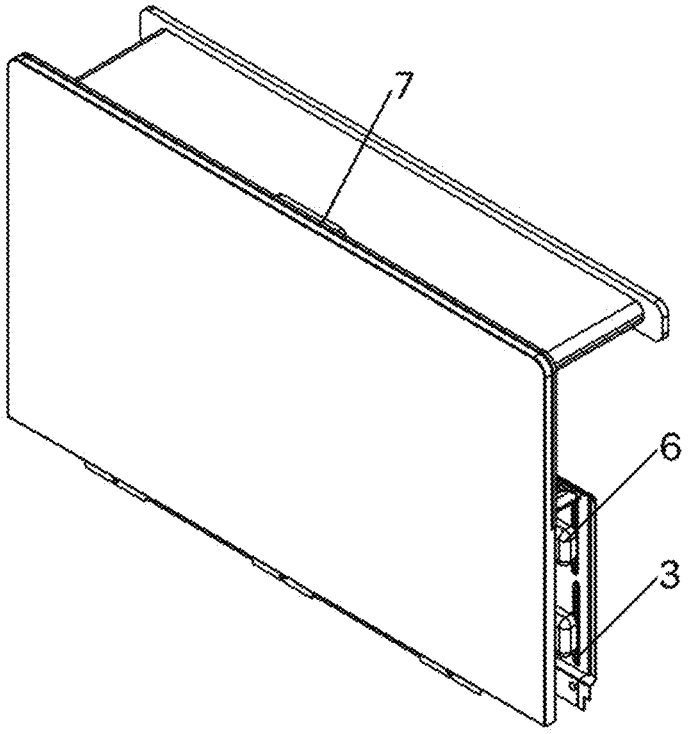
FIG. 3 is a schematic diagram of a self-cleaning head assembly of an integrated cooking range according to the present disclosure.
Figure 4:
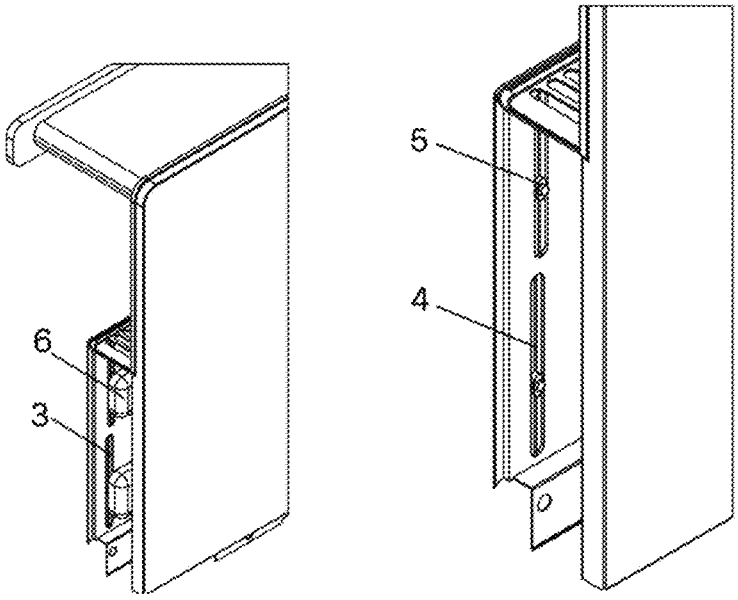
FIG. 4 is a partial schematic diagram of a self-cleaning head assembly of an integrated cooking range according to the present disclosure.
Figure 5:
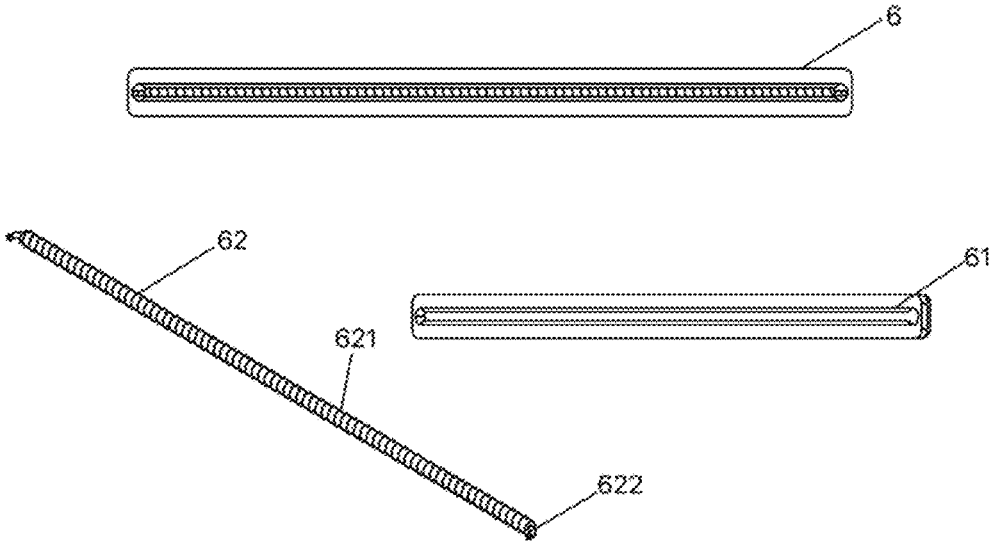
FIG. 5 is a structural schematic diagram of a flow-guiding baffle plate according to the present disclosure.
Figure 6:
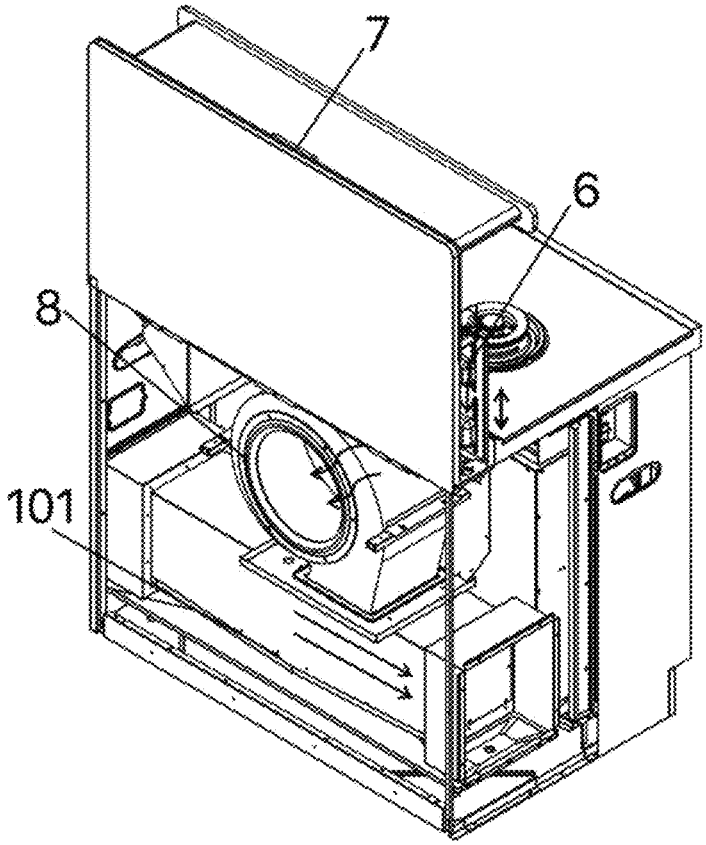
FIG. 6 is a schematic diagram illustrating self-cleaning of an integrated cooking range according to the present disclosure.

Reference numerals in the accompanying drawings: 1. integrated cooking range head assembly housing; 11. front baffle; 12. side panel; 13. rear baffle; 14. top panel; 2. oil filter screen; 3. slide rail; 4. sliding rod; 5. telescopic motor; 6. flow-guiding baffle plate; 61. plate body; 62. heating tube; 621. tube body; 622. resistance wire; 7. temperature sensor; 8. fan system; 9. air outlet; 10. exhaust duct; 101. grease collection hopper; 21. cooktop; and 31. steam oven.

DETAILED DESCRIPTIONS OF THE EMBODIMENTS

In order to clarify the objectives, technical solutions, and advantages of the present disclosure, the technical solutions of the present disclosure will be described in detail below. Apparently, the examples described are merely illustrative and do not constitute all possible embodiments of the present disclosure. All other embodiments that can be obtained by those of ordinary skill in the art based on the embodiments of the present disclosure without undue inventive efforts are intended to fall within the scope of protection of the present disclosure.

As shown in FIGS. 1-11, an integrated cooking range head assembly device having a flow-control noise reduction function and a self-cleaning function is provided. An integrated cooking range head assembly device is fixed to an upper portion of an integrated cooking range head assembly housing via bolts, and includes an integrated cooking range head assembly housing 1 and a flow-guiding baffle plate assembly disposed on the integrated cooking range head assembly housing 1.

The integrated cooking range head assembly housing 1 includes a front baffle 11, side panels 12, a rear baffle 13, and a top panel 14 disposed above the rear baffle 13. An oil filter screen 2 is disposed between the front baffle 11 and the rear baffle 13, and a temperature sensor 7 is disposed on a top of the rear baffle 13. The flow-guiding baffle plate assembly is disposed on an inner side of the front baffle 11 to optimize and guide an oil fume flow channel and to achieve the self-cleaning function. The flow-guiding baffle plate assembly includes two flow-guiding baffle plates 6 arranged in parallel on the inner side of the front baffle 11, with each flow-guiding baffle plate 6 having an arc-shaped outer surface. The integrated cooking range head assembly housing 1 is generally rectangular and cooperates with the flow-guiding baffle plate assembly to form the head air intake duct.

To enable adjustment of positions of the flow-guiding baffle plates 6, slide rails 3 are arranged on both sides of the front baffle 11. The slide rails 3 are internally provided with sliding rods 4, and a telescopic motor 5 is connected to the sliding rods 4 via bolts. The flow-guiding baffle plate assembly is connected to the telescopic motor 5. The telescopic motor 5 is connected to the sliding rods 4 on the front baffle 11 via bolts. A height of the flow-guiding baffle plates 6 can be adjusted in a non-exhaust state by means of the sliding rods 4.

Each flow-guiding baffle plate 6 includes a plate body 61 and a heating tube 62. The plate body 61 and the heating tube 62 are connected via a snap-fit structure, enabling replacement of the plate body.

The heating tube 62 includes a tube body 621 and a resistance wire 622 wound around the tube body 621. The heating tube 62 is embedded within the flow-guiding baffle plate 6, and provides heating by the resistance wire 622 wound around the tube. A specific power of the resistance wire 622 is controlled based on the external temperature sensor 7.

Both ends of the heating tube 62 are connected to the telescopic motor 5. Through action of the telescopic motor 5, the flow-guiding baffle plates 6 can be adjusted forward and backward. The sliding rods 4 can be rotated to adjust the telescopic motor 5 up and down, thereby adjusting the flow-guiding baffle plates 6 upward and downward.

Two flow-guiding baffle plates 6 are provided, one of the flow-guiding baffle plates near the integrated cooking range head assembly housing serves as a first flow-guiding baffle plate, and the other flow-guiding baffle plate away from the integrated cooking range head assembly housing is a second flow-guiding baffle plate. During an optimization process, structural parameters of the two flow-guiding baffle plates 6 have no absolute dimensions relationship and are treated as adjustable parameters.

Figure 12:
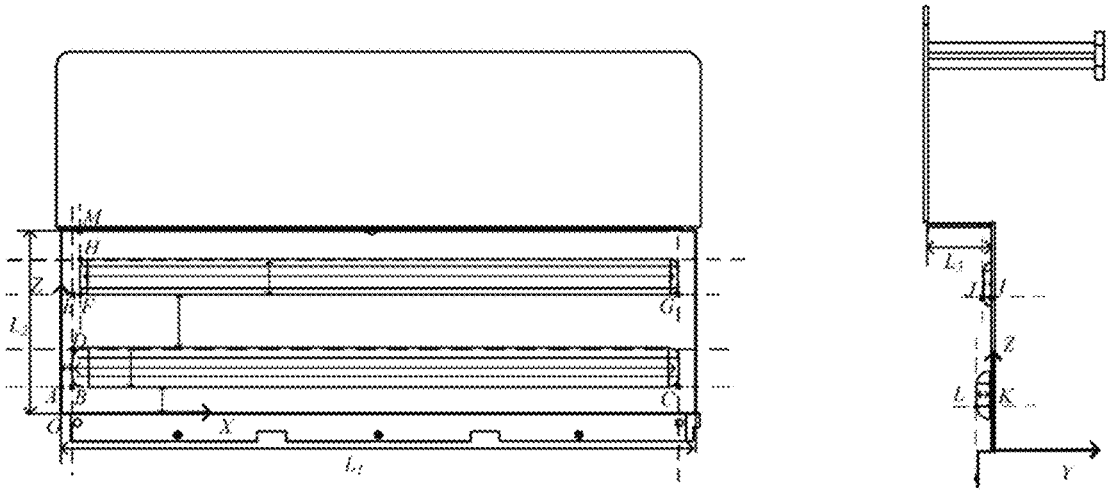
FIG. 12 is a schematic diagram illustrating parameter definitions of a flow-guiding baffle plate of a self-cleaning head assembly of an integrated cooking range according to the present disclosure.

The design of the flow-guiding baffle plates 6 is controlled by four variables: lengths of the flow-guiding baffle plates, thicknesses of the flow-guiding baffle plates, a spacing between the flow-guiding baffle plates, and a distance between the flow-guiding baffle plates and the head assembly. Positions and structural parameters of the flow-guiding baffle plates 6 are defined as follows, with reference to FIG. 12:

(S1) establishing a spatial rectangular coordinate system, defining positions of the flow-guiding baffle plates and structural parameters of the flow-guiding baffle plates; letting a total lower long side of the head air intake duct be L1 and an inner side of the head air intake duct be L2, and enabling the L1 and the L2 to intersect at a point O; the point O is taken as an origin; setting a direction along the L1 as an X-axis, a direction along the L2 as a Z-axis, and a direction perpendicular to both the X-axis and the Z-axis and passing through the point O along a height direction as a Y-axis, thereby establishing the spatial rectangular coordinate system;

(S2) selecting eight points on the front baffle of the integrated cooking range head assembly housing, denoted as A(x1, z1), B(x2, z2), C(x3, z3), D(x4, z4), E(x5, z5), F(x6, z6), G(x7, z7), and H(x8, z8), respectively, where L2 denotes a total height of the side of the integrated cooking range head assembly housing, L1 denotes a total length of the lower side, and L3 denotes a total thickness of the integrated cooking range head assembly housing; segments OA, AB, BC, BD, DE, EF, FG, and FH are all straight lines; the point O is an origin of a coordinate axis, that is, O(0,0); since segment OA extends along the Z-axis, coordinates of point A are (0, z1); segments AB and BC extend along the X-axis, so coordinates of points B and C are (x1, z1) and (x2, z1), respectively; segments BD and DE extend along the Z-axis, so points D and E have coordinates (x1, z2) and (x1, z3), respectively; segments EF and FG are horizontal, so points F and G have coordinates (x3, z3) and (x4, z3), respectively; and segments FH and HM are vertical, so points H and M have coordinates (x3, z4) and (x3, L2), respectively;

where x1+x2=x3+x4=L1, such that the positions and length coordinates of the flow-guiding baffle plates are completely defined;

(S3) selecting four points on the side of the integrated cooking range head assembly housing, denoted as I (y1, z1), J(y2, z2), K(y3, z3) and L(y4, z4), since segments IJ and KL both extend along the Y-axis, and segment IK extends along the Z-axis, coordinates of point K are (0, z5), coordinates of point I are (0, z6), coordinates of point L are (−y1, z5), and coordinates of point J are (−y2, z6); and in this manner, the thickness of the flow-guiding baffle plates is completely defined. During the parameter setting, the lengths of the straight-line segments may be 0. In the optimization process, the case where the two flow-guiding baffle plates are in direct contact cannot be ignored, that is, the two flow-guiding baffle plates form a single trapezoidal or rectangular flow-guiding baffle plate; and (S4) performing geometric modeling using 3D design software based on a flow-guiding baffle plate profile determined by the sample points, followed by simulation calculations to obtain an outlet airflow and a noise level of each model; establishing a functional relationship between the design variables, the outlet airflow and the noise level based on an approximate model, and evaluating an accuracy of the approximate model using a coefficient of determination $R^2$; determining a final selected approximate model, and optimizing the final selected approximate model using an optimization algorithm; and determining the structural parameters of the flow-guiding baffle plates based on the obtained optimal solution, performing a final geometric modeling using the 3D design software, and completing the optimization process.

In summary, simulations are performed according to the defined structural parameters of the flow-guiding baffle plates, and optimization is performed according to the overall streamline (without significant vortices) and turbulent kinetic energy, matching different airflow inlet angles for various appliance models to improve overall airflow performance and optimize noise characteristics.

Edges of the flow-guiding baffle plates are arc-shaped. According to the Coandă effect, oil fumes can flow along a curvature of the flow-guiding baffle plates, thereby enhancing the guiding effect of the flow-guiding baffle plates on the oil fumes.

Another objective of the present disclosure is to provide an integrated cooking range having a self-cleaning head assembly function, including the integrated cooking range head assembly device having a flow-control noise reduction function and a self-cleaning function, and an integrated cooking range head assembly housing, where the integrated cooking range head assembly device is fixed to an upper portion of the integrated cooking range head assembly housing via bolts. The integrated cooking range head assembly housing is rectangular as a whole and includes an integrated cooking range head assembly device, a fan system, an air intake duct, an exhaust duct, and the like; and referring to FIG. 1, the integrated cooking range is provided with a built-in fan system 8, including a volute, a motor, an impeller, and a collector ring. The integrated cooking range head assembly device is disposed above the integrated cooking range head assembly housing and fixed to the integrated cooking range head assembly housing via bolts. A cooktop 21 is arranged on the upper portion of the integrated cooking range head assembly housing, and a steam oven 31 and the fan system 8 are disposed inside the integrated cooking range head assembly housing.

The integrated cooking range head assembly housing further includes air outlets 9 formed on left and right sides of the integrated cooking range, with corresponding exhaust ducts 10. An outlet of the fan system 8 is in communication with the exhaust ducts 10, and orientations of the air outlets 9 may be adjusted according to a left-right arrangement of the integrated cooking range. A grease collection hopper 101 is arranged on the exhaust ducts 10.

The integrated cooking range head assembly device is internally provided with the flow-guiding baffle plates 6, and structures and positions of the flow-guiding baffle plates 6 are determined based on a flow-control theory.

Figure 7:
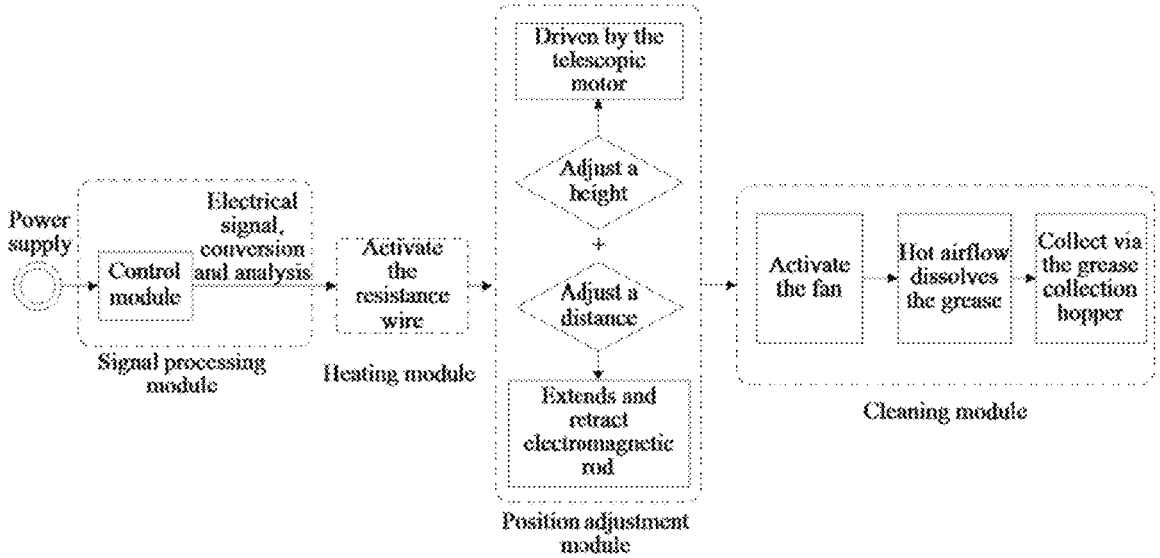
FIG. 7 is a schematic flowchart of a cleaning module of a self-cleaning head assembly of an integrated cooking range according to the present disclosure.
Figure 8:
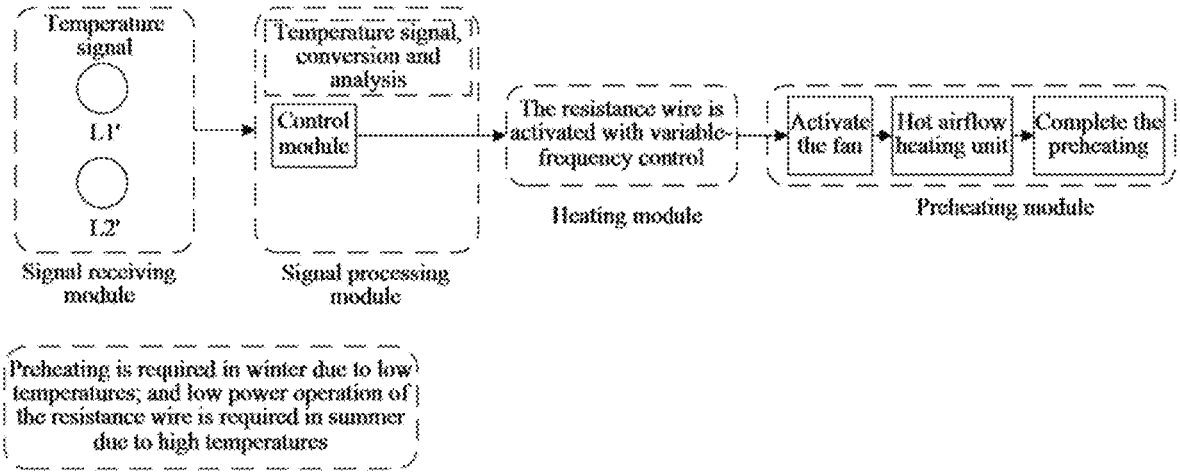
FIG. 8 is a schematic flowchart of a preheating module of a self-cleaning head assembly of an integrated cooking range according to the present disclosure.
Figure 9:
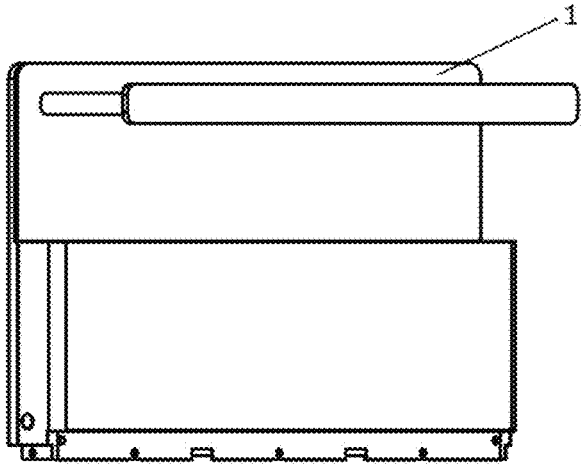
FIG. 9 is a schematic structural diagram of a prototype head assembly according to the present disclosure.
Figure 10:
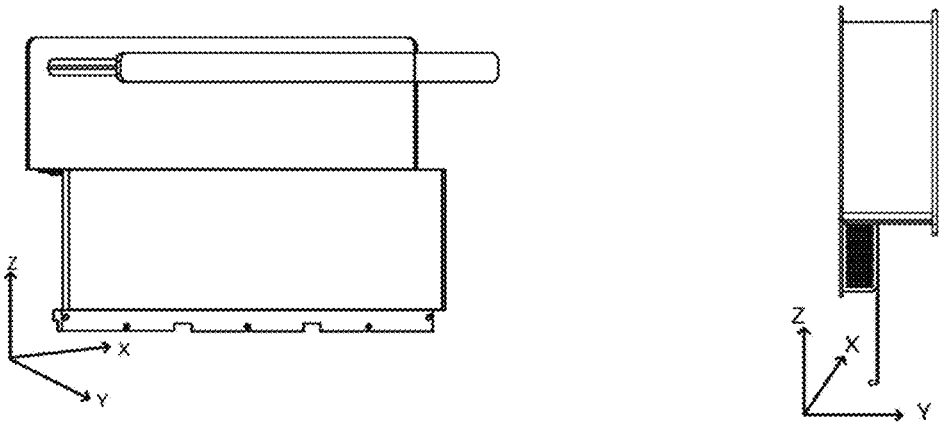
FIG. 10 is a schematic diagram of spatial coordinates of a head assembly of an integrated cooking range according to the present disclosure.
Figure 11:
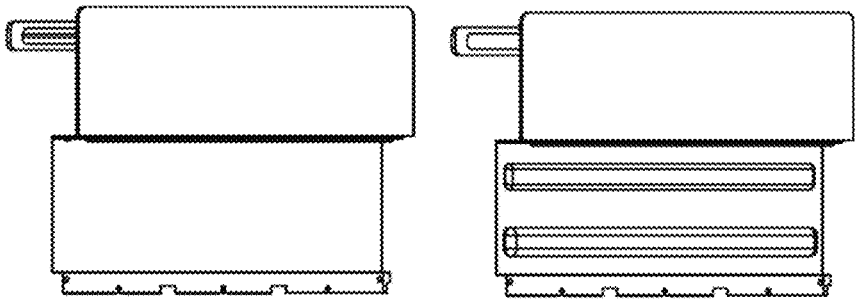
FIG. 11 is a comparison diagram of a prototype head assembly and a novel head assembly of an integrated cooking range according to the present disclosure.

A self-cleaning functional module of the device of the present disclosure can operate in two modes, as shown in FIGS. 7 and 8. In a cleaning mode, the heating tube 62 is activated, and the positions of the flow-guiding baffle plates 6 are adjusted via the slide rails 3 and the telescopic motor 5. The sliding rods 4 are driven to rotate by a sliding motor to achieve a height adjustment of the telescopic motor 5, thereby adjusting heights of the flow-guiding baffle plates 6. A distance between the of the flow-guiding baffle plates 6 is achieved through the extension and retraction of an electromagnetic telescopic rod of the telescopic motor 5, allowing the flow-guiding baffle plates 6 to clean the integrated cooking range head assembly device as a whole. The fan system 8 is activated to carry away dissolved grease and heat the integrated cooking range head assembly device with hot air. Larger oil droplets fall under gravity and are collected in the grease collection hopper 101 of the exhaust duct 10, while smaller oil droplets are discharged directly.

A preheating module is linked to the external temperature sensor 7. An operating power of the resistance wire is adjusted according to an actual ambient temperature. In winter, when the ambient temperature is low, the operating power of the resistance wire is increased to heat an inlet air, preheating the integrated cooking range head assembly device through the fan system 8 as a whole. In summer, when the ambient temperature is high, the resistance wire operates at a low operating power or remains off, providing simple preheating of the integrated cooking range.

A brief description of the self-cleaning module is as follows: 1. The heating tube 62 inside the flow-guiding baffle plates 6 is activated. The flow-guiding baffle plates 6 move up and down along the slide rails 3, and the flow-guiding baffle plates 6 are pushed forward/backward by the telescopic motor 5, causing a temperature of the head assembly to rise rapidly, quickly dissolving adhering grease. 2. After the head assembly is heated for 5-10 min, the fan system 8 is activated to carry away dissolved grease and heat the head assembly with hot air. Larger oil droplets fall under gravity and are collected in the grease collection hopper 101 of the exhaust duct 10, while smaller oil droplets are discharged directly.

Figure 13:
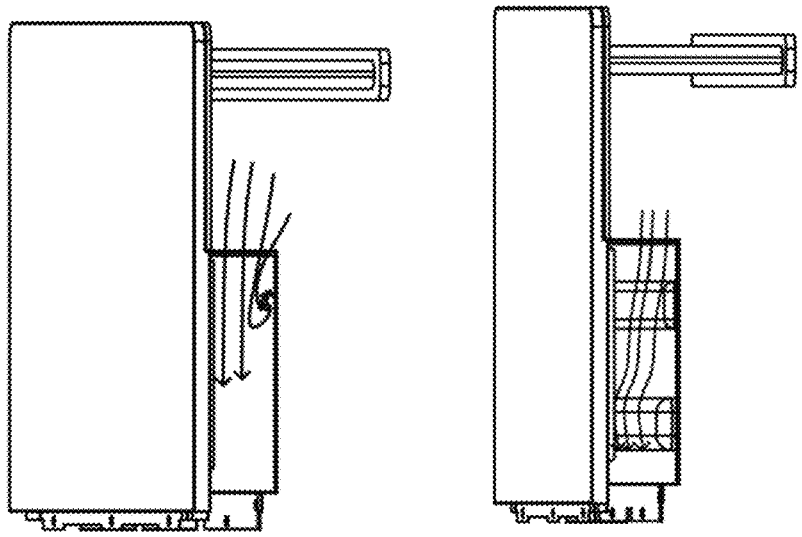
FIG. 13 is a schematic diagram of a comparison of oil fume flow between a prototype head assembly and a novel head assembly provided by the present disclosure.

FIG. 13 is a schematic diagram of a comparison of oil fume flow between a prototype head assembly and a novel head assembly of an integrated cooking range provided by the present disclosure. The comparison indicates, due to the arrangement of the flow-guiding baffle plates, the oil fume streamlines are improved and energy losses are reduced, thereby achieving a noise reduction effect.

The foregoing description illustrates only specific embodiments of the present disclosure and is not intended to limit the scope of protection thereof. Modifications and variations that may be easily conceived by those skilled in the art in light of the teachings of the present disclosure shall fall within the scope of protection of the present disclosure. Therefore, the scope of protection of the present disclosure shall be defined by the appended claims.

The invention claimed is:

1. An integrated cooking range head assembly device having a flow-control noise reduction function and a self-cleaning function, comprising an integrated cooking range head assembly housing, wherein the integrated cooking range head assembly housing comprises a front baffle, side panels, a rear baffle, and a top panel disposed above the rear baffle, and the front baffle, the side panels, and the rear baffle together form a head air intake duct; an oil filter screen is disposed between the front baffle and the rear baffle, a temperature sensor is disposed on a top of the rear baffle, and a flow-guiding baffle plate assembly is disposed on an inner side of the front baffle to optimize and guide an oil fume flow channel and to achieve the self-cleaning function;

wherein slide rails are arranged on both sides of the front baffle, the slide rails are internally provided with sliding rods, a telescopic motor is connected to the sliding rods via bolts, and the flow-guiding baffle plate assembly is connected to the telescopic motor.

2. The integrated cooking range head assembly device having a flow-control noise reduction function and a self-cleaning function according to claim 1, wherein the flow-guiding baffle plate assembly comprises two flow-guiding baffle plates arranged in parallel on the inner side of the front baffle, with each flow-guiding baffle plate having an arc-shaped outer surface.

3. The integrated cooking range head assembly device having a flow-control noise reduction function and a self-cleaning function according to claim 2, wherein each flow-guiding baffle plate comprises a plate body and a heating tube, and the plate body and the heating tube are connected via a snap-fit structure, enabling replacement of the plate body.

4. The integrated cooking range head assembly device having a flow-control noise reduction function and a self-cleaning function according to claim 3, wherein the heating tube comprises a tube body and a resistance wire wound around the tube body; both ends of the heating tube are connected to the telescopic motor; through action of the telescopic motor, the flow-guiding baffle plates are adjusted forward and backward; and the sliding rods are rotated to adjust the telescopic motor up and down, thereby adjusting the flow-guiding baffle plates upward and downward.

5. The integrated cooking range head assembly device having a flow-control noise reduction function and a self-cleaning function according to claim 4, wherein the flow-control noise reduction is achieved by parameterizing structures and positions of the flow-guiding baffle plates, and optimizing different structures and positions of the flow-guiding baffle plates, and a parameter design of the flow-guiding baffle plates is controlled by four variables: lengths of the flow-guiding baffle plates, thicknesses of the flow-guiding baffle plates, a spacing between the flow-guiding baffle plates, and a distance between the flow-guiding baffle plates and the head assembly, with an optimization process as follows:

S1: establishing a spatial rectangular coordinate system, defining positions of the flow-guiding baffle plates and structural parameters of the flow-guiding baffle plates; letting a total lower long side of the head air intake duct be $L_1$ and an inner side of the head air intake duct be $L_2$, and enabling the $L_1$ and the $L_2$ to intersect at a point O; the point O is taken as an origin; setting a direction along the $L_1$ as an X-axis, a direction along the $L_2$ as a Z-axis, and a direction perpendicular to both the X-axis and the Z-axis and passing through the point O along a height direction as a Y-axis, thereby establishing the spatial rectangular coordinate system;

S2: selecting eight points on the front baffle of the integrated cooking range head assembly housing, denoted as $A(X_1, Z_1)$, $B(X_2, Z_2)$, $C(X_3, Z_3)$, $D(X_4, Z_4)$, $E(X_5, Z_5)$, $F(X_6, Z_6)$, $G(X_7, Z_7)$, and $H(X_8, Z_8)$, respectively, wherein $L_2$ denotes a total height of the side of the integrated cooking range head assembly housing, $L_1$ denotes a total length of the lower side, and $L_3$ denotes a total thickness of the integrated cooking range head assembly housing; segments OA, AB, BC, BD, DE, EF, FG, and FH are all straight lines; the point O is an origin of a coordinate axis, that is, O (0,0); since segment OA extends along the Z-axis, coordinates of point A are $(0, Z_1)$; segments AB and BC extend along the X-axis, so coordinates of points B and C are $(X_1, Z_1)$ and $(X_2, Z_1)$, respectively; segments BD and DE extend along the Z-axis, so points D and E have coordinates $(X_1, Z_2)$ and $(X_1, Z_3)$, respectively; segments EF and FG are horizontal, so points F and G have coordinates $(X_3, Z_3)$ and $(X_4, Z_3)$, respectively; and segments FH and HM are vertical, so points H and M have coordinates $(X_3, Z_4)$ and $(X_3, L_2)$, respectively; wherein $X_1+X_2=X_3+X_4=L_1$, such that the positions and length coordinates of the flow-guiding baffle plates are completely defined;

S3: selecting four points on the side of the integrated cooking range head assembly housing, denoted as $I(y_1, Z_1)$, $J(y_2, Z_2)$, $K(y_3, Z_3)$ and $L(y_4, Z_4)$, since segments IJ and KL both extend along the Y-axis, and segment IK extends along the Z-axis, coordinates of point K are $(0, Z_5)$, coordinates of point I are $(0, Z_6)$, coordinates of point L are $(-y_1, Z_5)$, and coordinates of point J are $(-y_2, Z_6)$, such that the thickness of the flow-guiding baffle plates is completely defined; and S4: performing geometric modeling using 3D design software based on a flow-guiding baffle plate profile determined by the sample points, followed by simulation calculations to obtain an outlet airflow and a noise level of each model; establishing a functional relationship between the design variables, the outlet airflow and the noise level based on an approximate model, and evaluating an accuracy of the approximate model using a coefficient of determination $R^2$; determining a final selected approximate model, and optimizing the final selected approximate model using an optimization algorithm; and determining the structural parameters of the flow-guiding baffle plates based on the obtained optimal solution, performing a final geometric modeling using the 3D design software, and completing the optimization process.

6. The integrated cooking range head assembly device having a flow-control noise reduction function and a self-cleaning function according to claim 4, wherein the self-cleaning function is achieved by adjusting the positions of the flow-guiding baffle plates and heating the heating tube, comprising two operating modes:

in a cleaning mode, the heating tube is activated, and the positions of the flow-guiding baffle plates are adjusted via the slide rails and the telescopic motor for overall cleaning of the head assembly; a fan system is then activated to carry away dissolved grease and heat the head assembly with hot air, larger oil droplets fall under gravity and are collected in a grease collection hopper of an exhaust duct, while smaller oil droplets are discharged directly; and in a preheating mode, a preheating module is linked to the external temperature sensor, an operating power of the resistance wire is adjusted according to an actual ambient temperature; when the ambient temperature is low in winter, the operating power of the resistance wire is increased to heat an inlet air, and preheat the integrated cooking range head assembly device through the fan system; and when the ambient temperature is high in summer, the resistance wire operates at a low operating power or remains off, providing simple preheating of the integrated cooking range.

7. An integrated cooking range having a self-cleaning head assembly function, comprising the integrated cooking range head assembly device having a flow-control noise reduction function and a self-cleaning function according to claim 1 and an integrated cooking range head assembly housing, wherein the integrated cooking range head assembly device is fixed to an upper portion of the integrated cooking range head assembly housing via bolts, a cooktop is arranged on the upper portion of the integrated cooking range head assembly housing, and a steam oven and a fan system are disposed inside the integrated cooking range head assembly housing.

8. The integrated cooking range having a self-cleaning head assembly function according to claim 7, further comprising air outlets formed on left and right sides of the integrated cooking range, with corresponding exhaust ducts; and an outlet of the fan system is in communication with the exhaust ducts, and orientations of the air outlets are adjusted according to a left-right arrangement of the integrated cooking range.

9. The integrated cooking range having a self-cleaning head assembly function according to claim 8, wherein a grease collection hopper is arranged on the exhaust ducts.

* * * * *